US011357323B2

(12) United States Patent
Nourse

(10) Patent No.: US 11,357,323 B2
(45) Date of Patent: Jun. 14, 2022

(54) ADJUSTABLE WORKSTATION WITH CABLE MANAGEMENT

(71) Applicant: Eaton Intelligent Power Limited, Dublin (IE)

(72) Inventor: Brian Nourse, Lancaster, MA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/535,909

(22) Filed: Aug. 8, 2019

(65) Prior Publication Data

US 2020/0046113 A1 Feb. 13, 2020

Related U.S. Application Data

(60) Provisional application No. 62/716,657, filed on Aug. 9, 2018.

(51) Int. Cl.
*A47B 21/06* (2006.01)
*A47B 21/02* (2006.01)

(52) U.S. Cl.
CPC ..... *A47B 21/06* (2013.01); *A47B 21/02* (2013.01); *A47B 2021/064* (2013.01)

(58) Field of Classification Search
CPC .... A47B 21/06; A47B 21/02; A47B 2021/064
See application file for complete search history.

(56) References Cited

U.S. PATENT DOCUMENTS

| | | | | |
|---|---|---|---|---|
| 1,786,823 | A | 12/1930 | Carrington et al. | |
| 3,125,387 | A | 3/1964 | Abrahamson | |
| 3,140,559 | A | 7/1964 | Grow et al. | |
| 3,273,517 | A | 9/1966 | Amthor, Jr. et al. | |
| 4,827,850 | A | 5/1989 | Diffrient | |
| 4,948,205 | A | 8/1990 | Kelley | |
| 5,384,937 | A * | 1/1995 | Simon | H02G 3/0443 211/181.1 |
| 5,451,101 | A | 9/1995 | Ellison et al. | |
| 5,802,988 | A | 9/1998 | Shields | |
| 5,853,236 | A | 12/1998 | Rogers et al. | |
| 5,878,673 | A | 3/1999 | Kramer et al. | |

(Continued)

FOREIGN PATENT DOCUMENTS

| | | | |
|---|---|---|---|
| CN | 206472384 | U | 9/2017 |
| WO | 2016195853 | A1 | 12/2016 |
| WO | 2017197395 | A1 | 11/2017 |

*Primary Examiner* — Daniel J Rohrhoff

(74) *Attorney, Agent, or Firm* — Stinson LLP

(57) ABSTRACT

A height-adjustable workstation includes a base assembly for being supported on a floor of a workspace. A work platform is disposed above the base assembly. The work platform has an upper surface, a lower surface, and side edges extending between the upper and lower surfaces and defining a perimeter of the work platform. A lift is operatively connected to the work platform and configured to selectively adjust an elevation of the work platform above the base assembly. A cable containment system is mounted on the base assembly. The cable containment system includes at least one cable containment component for containing cables associated with a device configured to be supported on the upper surface of the work platform. An entirety of the cable containment system is disposed within the perimeter of the work platform.

19 Claims, 15 Drawing Sheets

(56) References Cited

U.S. PATENT DOCUMENTS 5,988,076 A 11/1999 Vander Park
6,076,474 A 6/2000 Grabowski et al.
6,076,903 A 6/2000 Vander Park
6,152,048 A 11/2000 Vander Park
6,234,812 B1 5/2001 Ivers et al.
6,286,441 B1 9/2001 Burdi et al.
6,312,069 B1 11/2001 Weng
6,349,655 B1 2/2002 Carr et al.
6,382,747 B1 5/2002 Catta et al.
6,415,723 B1 * 7/2002 Kopish ..... A47B 3/0815 108/128
6,550,724 B2 4/2003 Gosling
6,817,684 B2 11/2004 Carlo
6,848,369 B1 2/2005 King et al.
7,125,088 B2 10/2006 Haberman
7,143,552 B2 12/2006 Vander Park
7,191,713 B2 3/2007 Gayhart et al.
7,412,931 B2 8/2008 Seidl et al.
7,640,866 B1 1/2010 Schermerhorn
7,665,255 B2 2/2010 Dressendorfer et al.
8,051,782 B2 11/2011 Nethken et al.
8,061,279 B2 11/2011 Preiss
8,109,215 B2 2/2012 Kitada et al.
8,146,229 B2 4/2012 Henriott et al.
8,177,172 B2 * 5/2012 Quertelet ..... H02G 3/0608 248/68.1
8,925,469 B2 1/2015 Bennie et al.
8,926,029 B2 1/2015 Han et al.
8,985,032 B1 3/2015 Johnson
9,220,342 B2 12/2015 Byrne et al.
9,439,507 B2 9/2016 Liu
9,516,945 B2 * 12/2016 Johnson ..... A47B 83/001
9,539,507 B2 1/2017 Schoenith et al.
9,585,468 B2 3/2017 Udagawa et al.
9,717,327 B2 5/2017 Kelley et al.
9,936,802 B1 4/2018 Newhouse
9,961,992 B2 5/2018 King et al.
9,961,993 B2 5/2018 McGowan et al.
9,999,295 B1 * 6/2018 Game ..... F16M 11/28
10,004,329 B2 * 6/2018 Nourse ..... A47B 21/06
10,028,576 B1 * 7/2018 Yao ..... A47B 9/20
10,186,819 B2 * 1/2019 Black ..... H01R 25/006
10,271,643 B2 4/2019 Yamamoto et al.
2003/0075080 A1 4/2003 Allen
2004/0144898 A1 * 7/2004 Spagnoli ..... H02G 3/32 248/68.1
2005/0231080 A1 10/2005 Torrance
2005/0279257 A1 12/2005 Bettinger
2006/0081157 A1 4/2006 Gayhart et al.
2009/0008512 A1 * 1/2009 Davis ..... H02G 3/0608 248/49
2009/0133609 A1 * 5/2009 Nethken ..... A47B 21/03 108/50.02
2013/0199420 A1 8/2013 Hjelm
2014/0096706 A1 4/2014 Labrosse et al.
2014/0208986 A1 7/2014 DesRoches et al.
2016/0113389 A1 4/2016 DesRoches et al.
2016/0360879 A1 12/2016 Kelley et al.
2018/0020828 A1 1/2018 Nourse et al.
2018/0055215 A1 * 3/2018 Vander Park ..... A47B 21/0314
2018/0110327 A1 * 4/2018 Keller ..... A47B 21/06
2018/0184800 A1 * 7/2018 Yamamoto ..... A47B 13/00

* cited by examiner

ADJUSTABLE WORKSTATION WITH CABLE MANAGEMENT

CROSS-REFERENCE TO RELATED APPLICATION

This application is the nonprovisional application of U.S. Provisional Application Ser. No. 62/716,657 filed Aug. 9, 2018, the entirety of which is incorporated by reference.

FIELD

The present disclosure generally relates to workstations, and more particularly to an adjustable workstation with a cable containment system for containing cables associated with electronic devices accessed from the workstation.

BACKGROUND

Workstations can support displays, user input devices, user output devices, and other electronic devices above a tabletop. It is often desirable to contain the signal and power cables associated with such devices. It may also be desirable to provide selective adjustment of the height of the tabletop so that a user may comfortably work at the workstation in a sitting position or a standing position.

SUMMARY

In one aspect, a height-adjustable workstation generally comprises a base assembly for being supported on a floor of a workspace. A work platform is disposed above the base assembly. The work platform has an upper surface, a lower surface, and side edges extending between the upper and lower surfaces and defining a perimeter of the work platform. A lift is operatively connected to the work platform and configured to selectively adjust an elevation of the work platform above the base assembly. A cable containment system is mounted on the base assembly. The cable containment system comprises at least one cable containment component for containing cables associated with a device configured to be supported on the upper surface of the work platform. An entirety of the cable containment system is disposed within the perimeter of the work platform.

In another aspect, a workstation assembly generally comprises a first height-adjustable workstation comprising a base assembly and a work platform disposed above the base assembly. A lift is operatively connected to the work platform and configured to selectively adjust an elevation of the work platform above the base assembly. A cable containment system is mounted on the base assembly. The cable containment system comprises at least one cable containment component for containing cables associated with a device configured to be supported on the work platform. The workstation assembly further comprises a second height-adjustable workstation comprising a base assembly and a work platform disposed above the base assembly of the second height-adjustable workstation. A lift is operatively connected to the work platform of the second height-adjustable workstation and configured to selectively adjust an elevation of the work platform of the second height-adjustable workstation above the base assembly of the second height-adjustable workstation. A cable containment system is mounted on the base assembly of the second height-adjustable workstation. The cable containment system of the second height-adjustable workstation comprises at least one cable containment component for containing cables associated with a device configured to be supported on the work platform of the second height-adjustable workstation. The cable containment component of the first height-adjustable workstation is disposed at a same height as the cable containment component of the second height-adjustable workstation so that cables can be routed between the first height-adjustable workstation and the second height-adjustable workstation.

BRIEF DESCRIPTION OF THE DRAWINGS

Corresponding reference characters indicate corresponding parts throughout the drawings.

DETAILED DESCRIPTION

Figure 1:
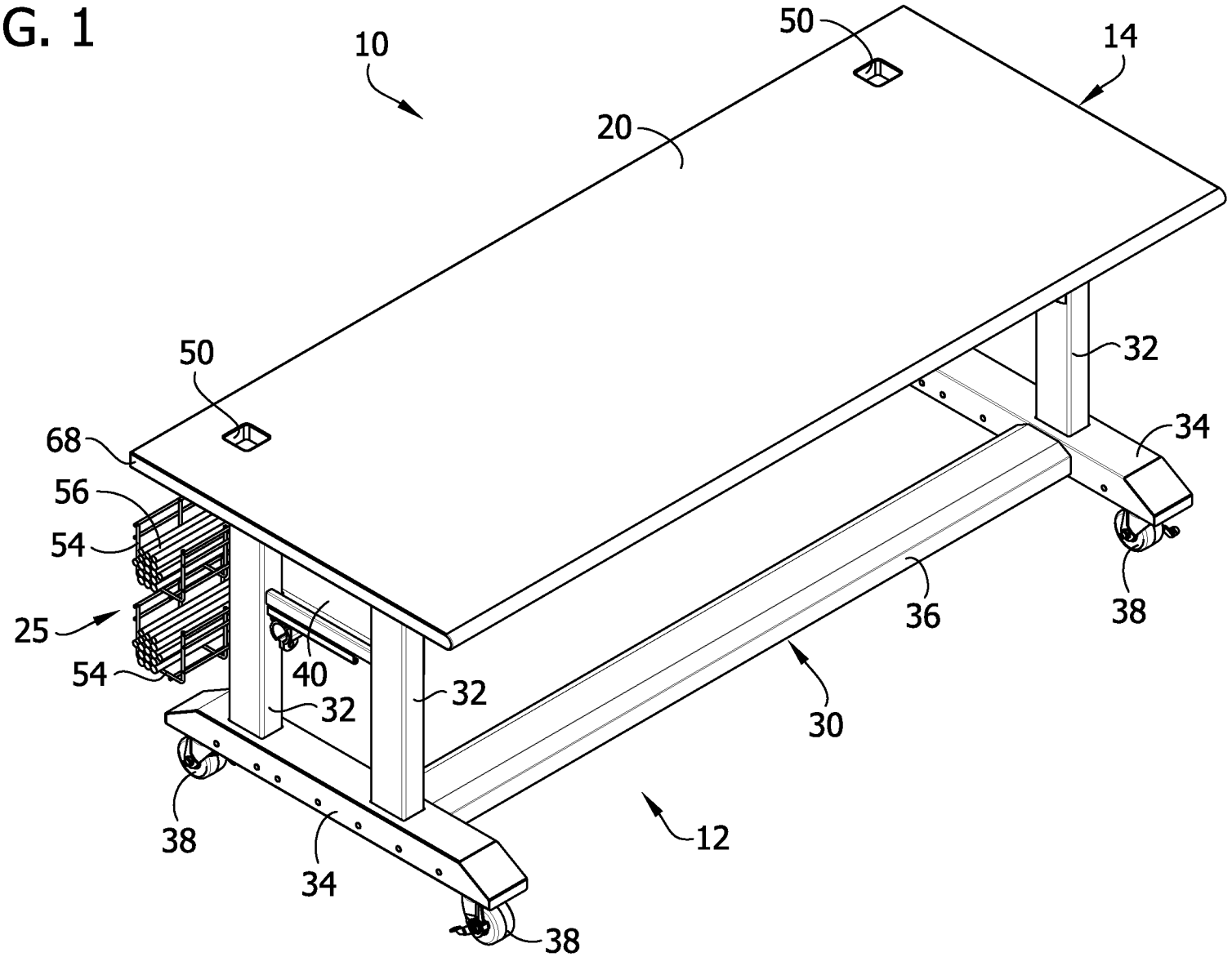
FIG. 1 is a front perspective of a workstation in a sitting configuration illustrating cables contained within a cable containment system.
Figure 2:
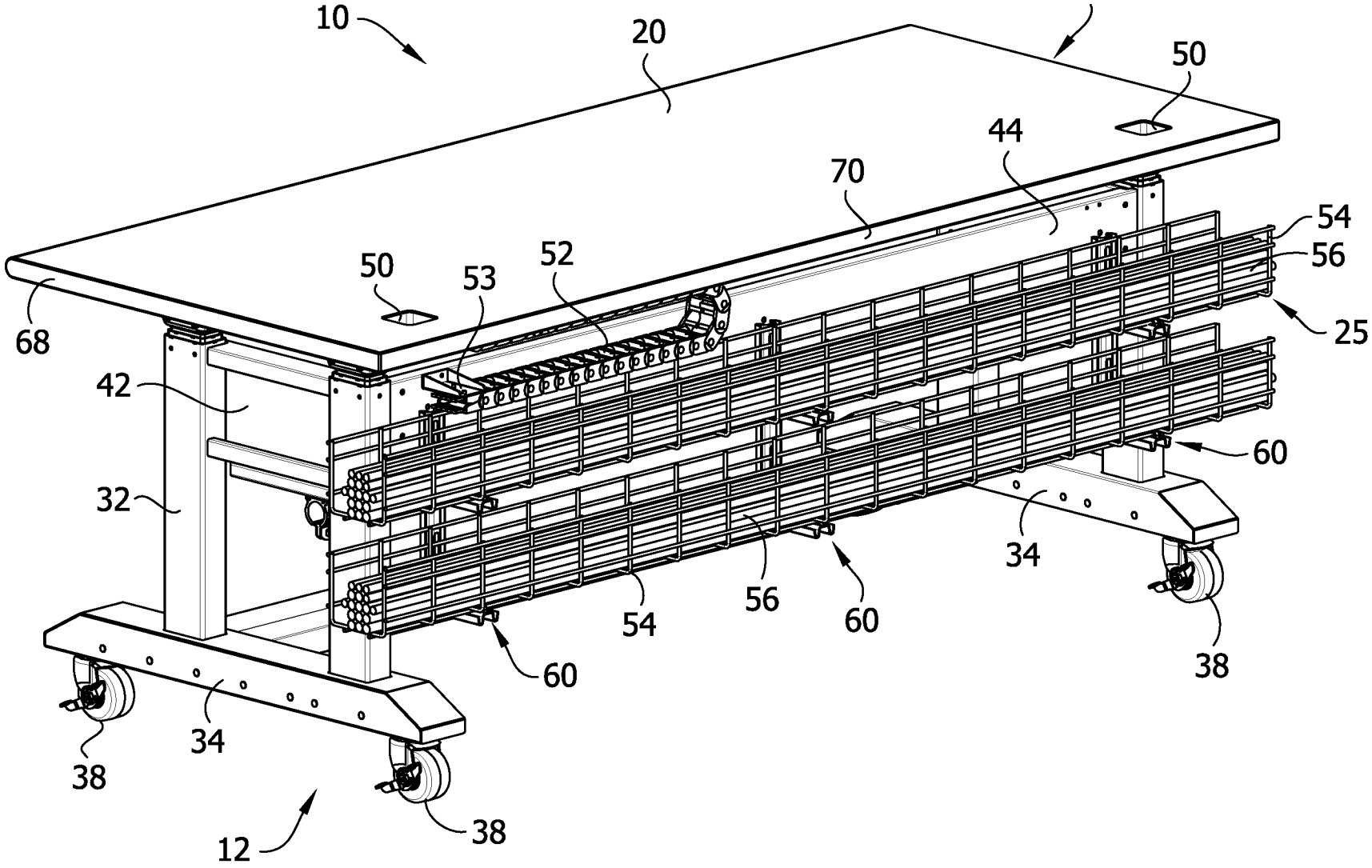
FIG. 2 is a rear perspective of the workstation.
Figure 3:
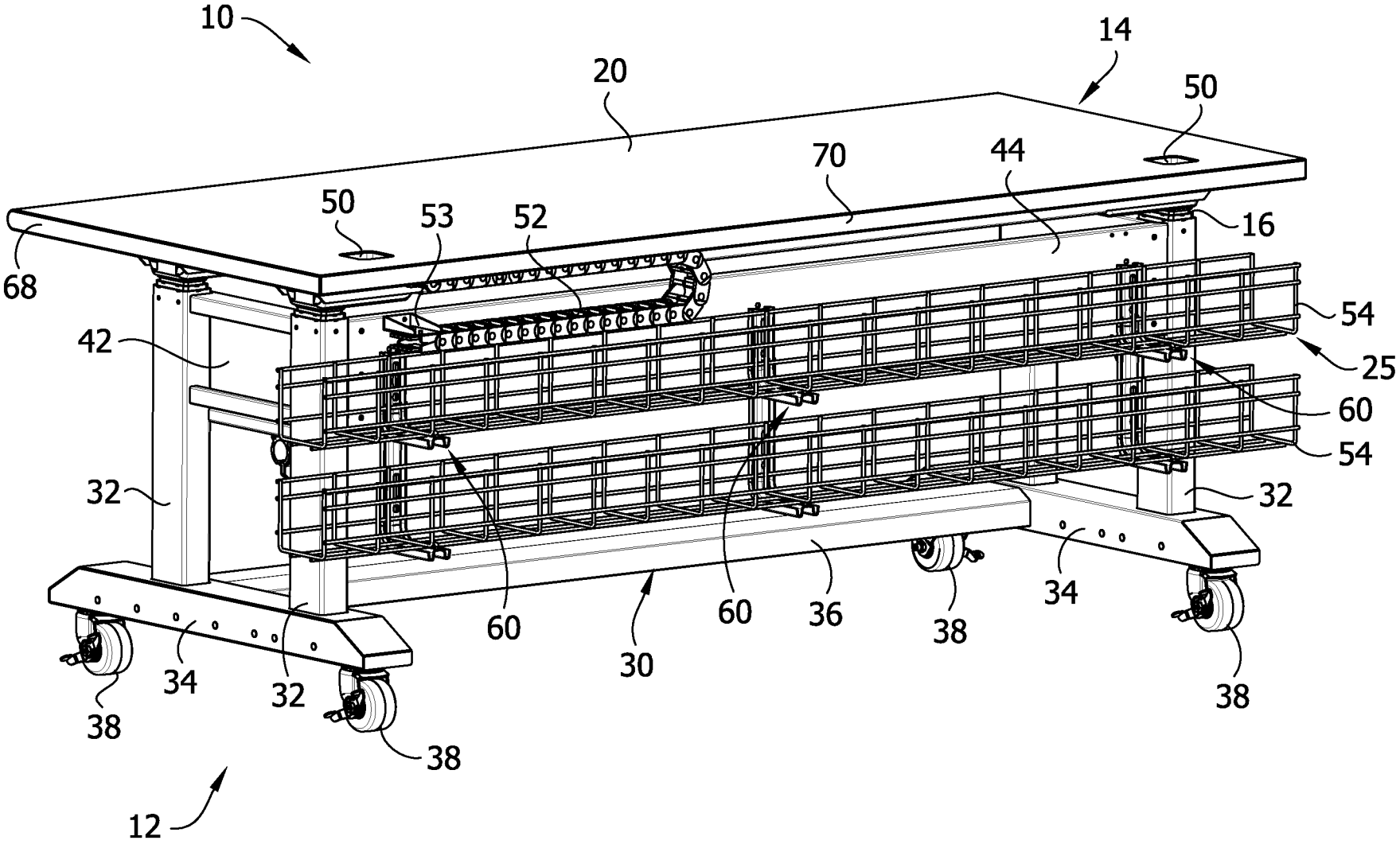
FIG. 3 is a perspective of the workstation with the cables removed from the cable containment system.
Figure 4:
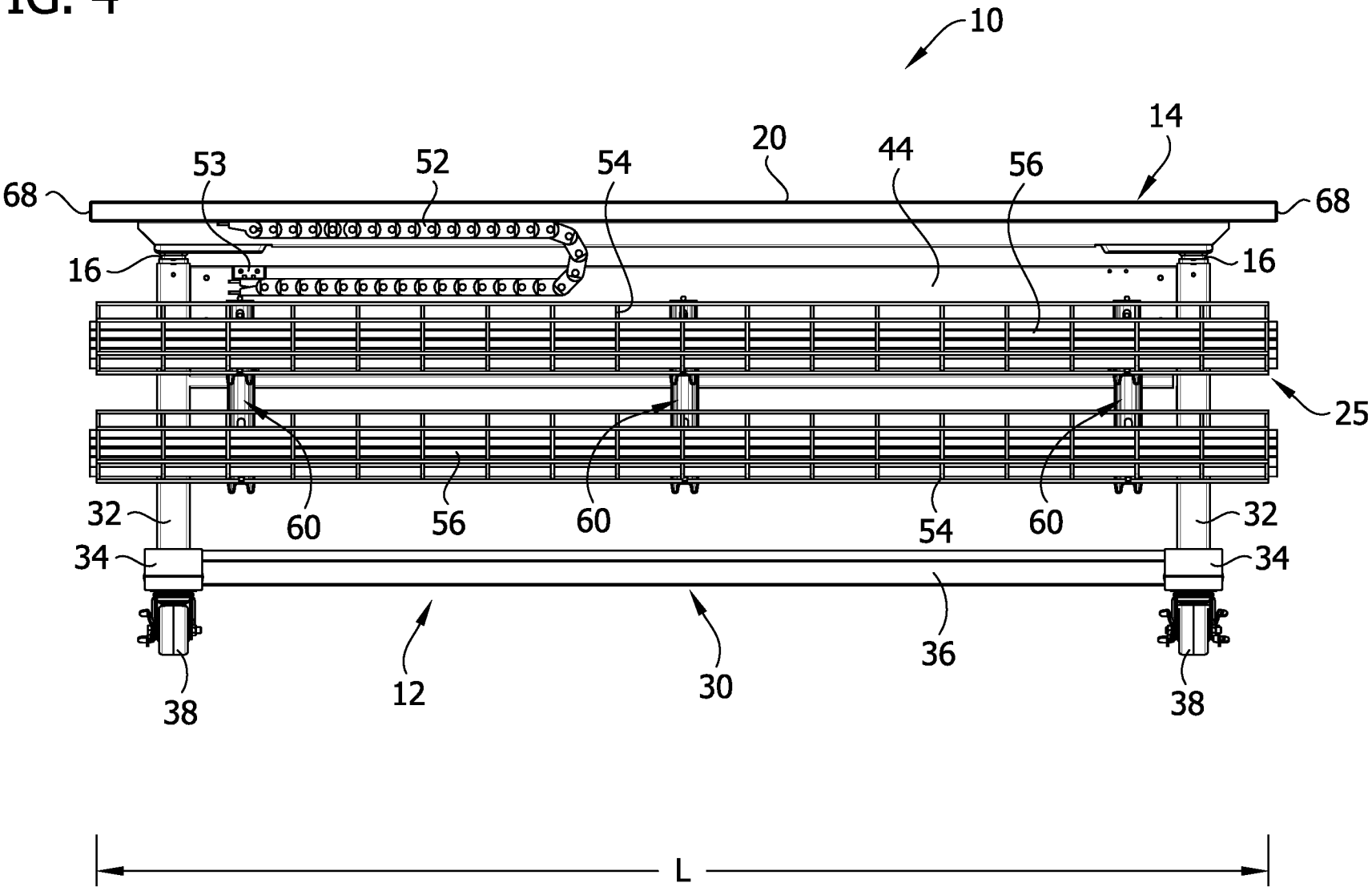
FIG. 4 is a rear elevation of the workstation.
Figure 5:
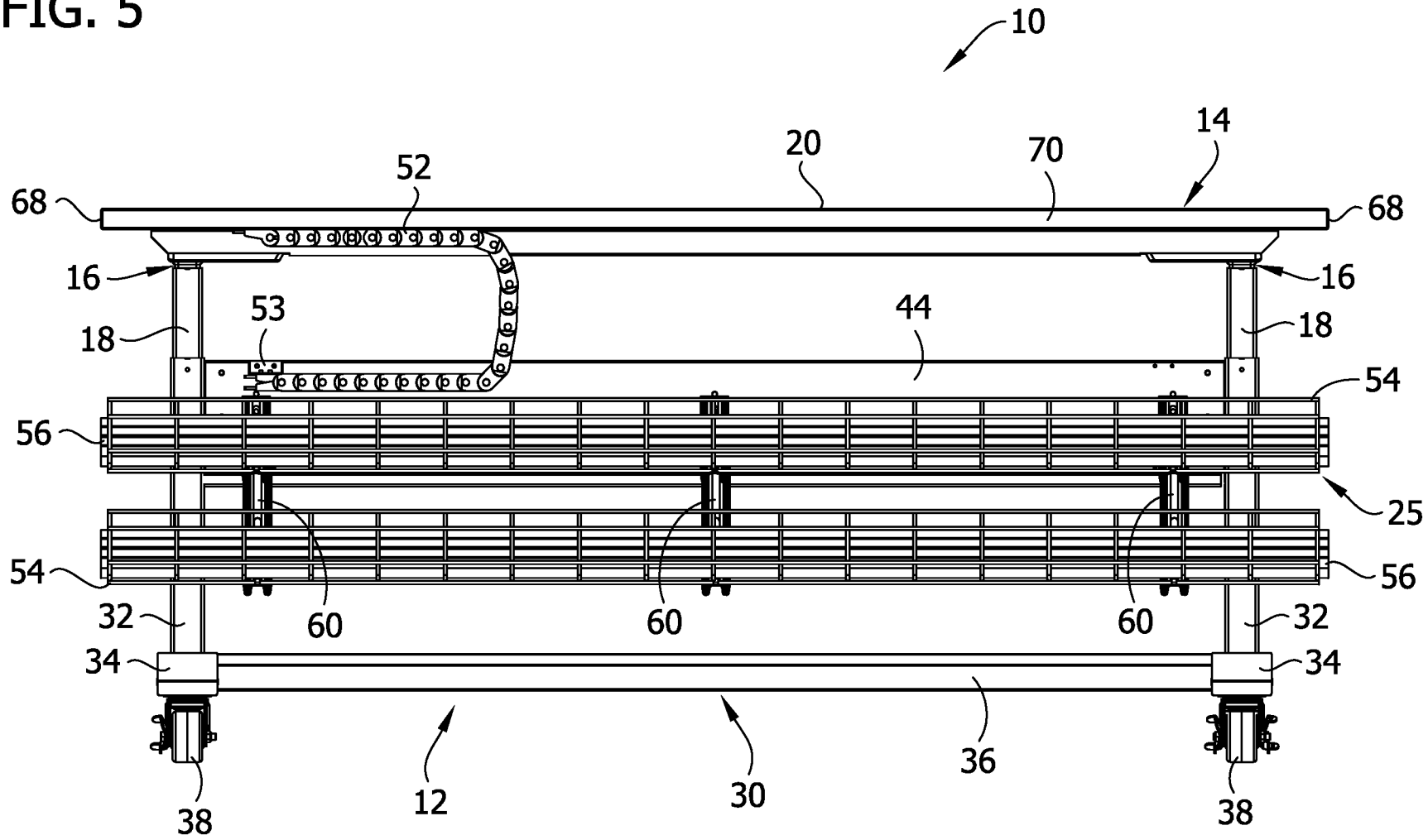
FIG. 5 is a rear elevation of the workstation in a standing configuration with a tabletop assembly in an elevated position.
Figure 6:
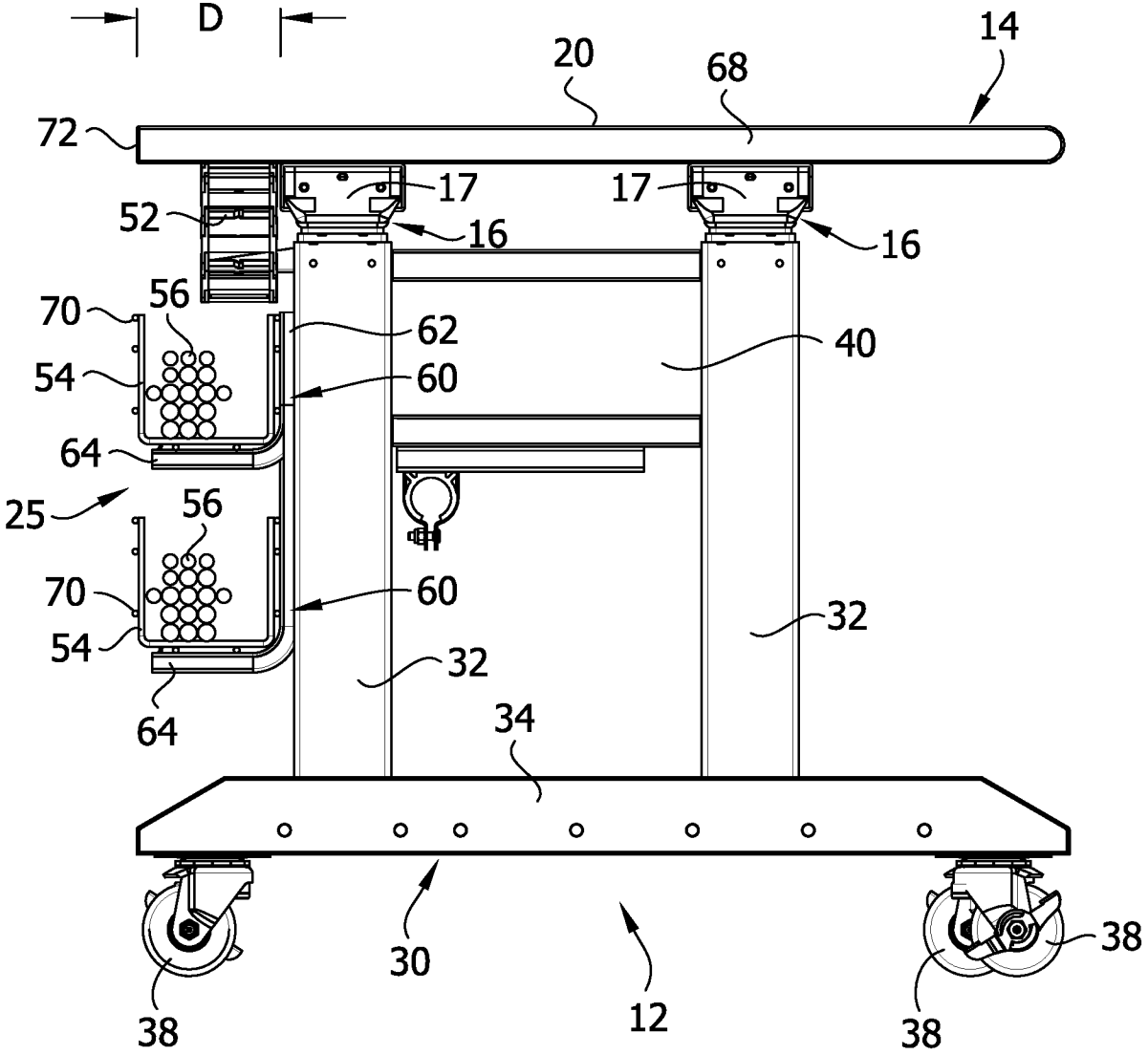
FIG. 6 is a side elevation of the workstation.

Referring to FIGS. 1-6, one embodiment of a workstation is generally indicated at 10. The workstation 10 includes a base assembly, generally indicated at 12, and a tabletop or desktop assembly, generally indicated at 14, mounted on the base assembly. The tabletop assembly 14 is positioned above the base assembly 12 for movement between a sitting position (FIG. 1), i.e., a lowered position, and a standing position (FIG. 5), i.e., an elevated position. More specifically, the tabletop assembly 14 is supported on lifts 16 for lifting the tabletop assembly 14 to the standing position and lowering the tabletop assembly to the sitting position. The lifts 16 each include a motor assembly 17 fixedly attached to the tabletop assembly 14 and configured for moving an extension member 18 operatively attached to the motor assembly relative to the base assembly 12 to move the tabletop assembly relative to the base assembly. In the sitting position, a work platform 20 of the tabletop assembly 14 is positioned at a height for access by a human user of about normal size seated in a conventional office chair. In the standing position, the work platform 20 is positioned at a height for access by a human user of about normal size who is standing on the floor. The work platform 20 is positionable to essentially any position between the sitting and standing positions to accommodate users of different sizes and preferences. The tabletop assembly 14 is configured to support electronic devices, such as displays and other user input/output devices (not shown) such as a keyboard, a mouse, a microphone, a speaker, etc. As explained in further detail below, the workstation 10 also includes a cable containment system, generally indicated at 25, which contains the power and signal cables 56 for the electronic devices of the workstation in both the standing position and the sitting position. The routing of cables through the cable containment system 25 will be described in detail below.

The base assembly 12 is configured for being supported on a floor of a workspace and includes a base support 30, and support legs 32 extending upward from the base support providing structural support for the workstation 10. In the illustrated embodiment, the base support 30 includes a pair of feet 34 at longitudinal ends of the base support, and a cross member 36 extending longitudinally between the feet. In the illustrated embodiment, the cross member 36 is positioned toward a front of the base support 30 so that in use the cross member can function as a foot rest for the user. Wheels 38 are disposed generally at ends of each of the feet 34 to permit the base assembly 12, and the workstation 10 as a whole, to be rolled within a work space. Panels are attached to the support legs 32 and include a first side panel 40 that extends between support legs associated with one of the feet 34, a second side panel 42 that extends between support legs associated with the other of the feet, and a rear panel 44 that extends between rear support legs associated with opposite feet. As will be explained in greater detail below, the rear panel 44 provides a mounting surface for attaching the cable containment system 25 to the base assembly 12.

Figure 7:
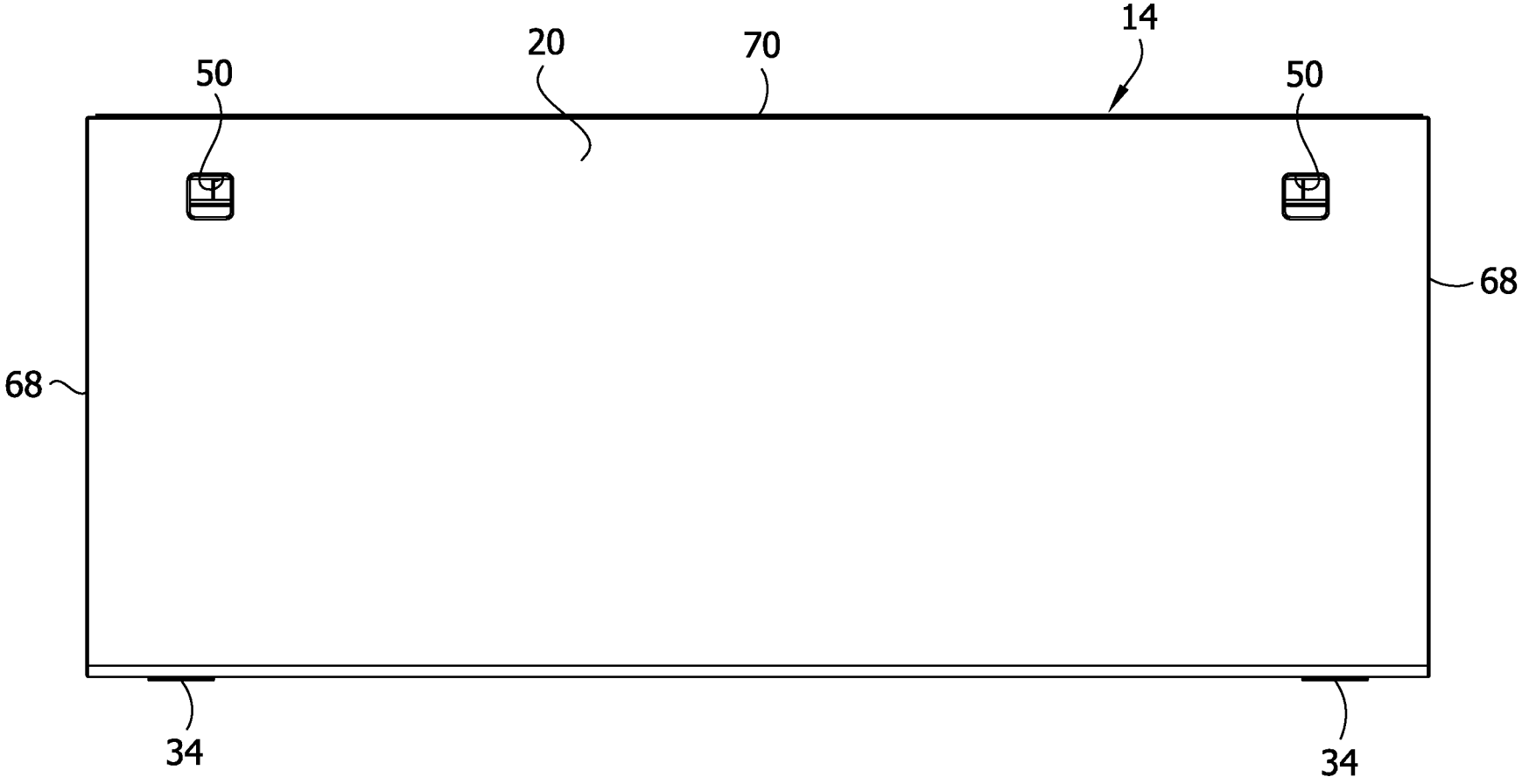
FIG. 7 is a top plan view of the workstation.
Figure 8:
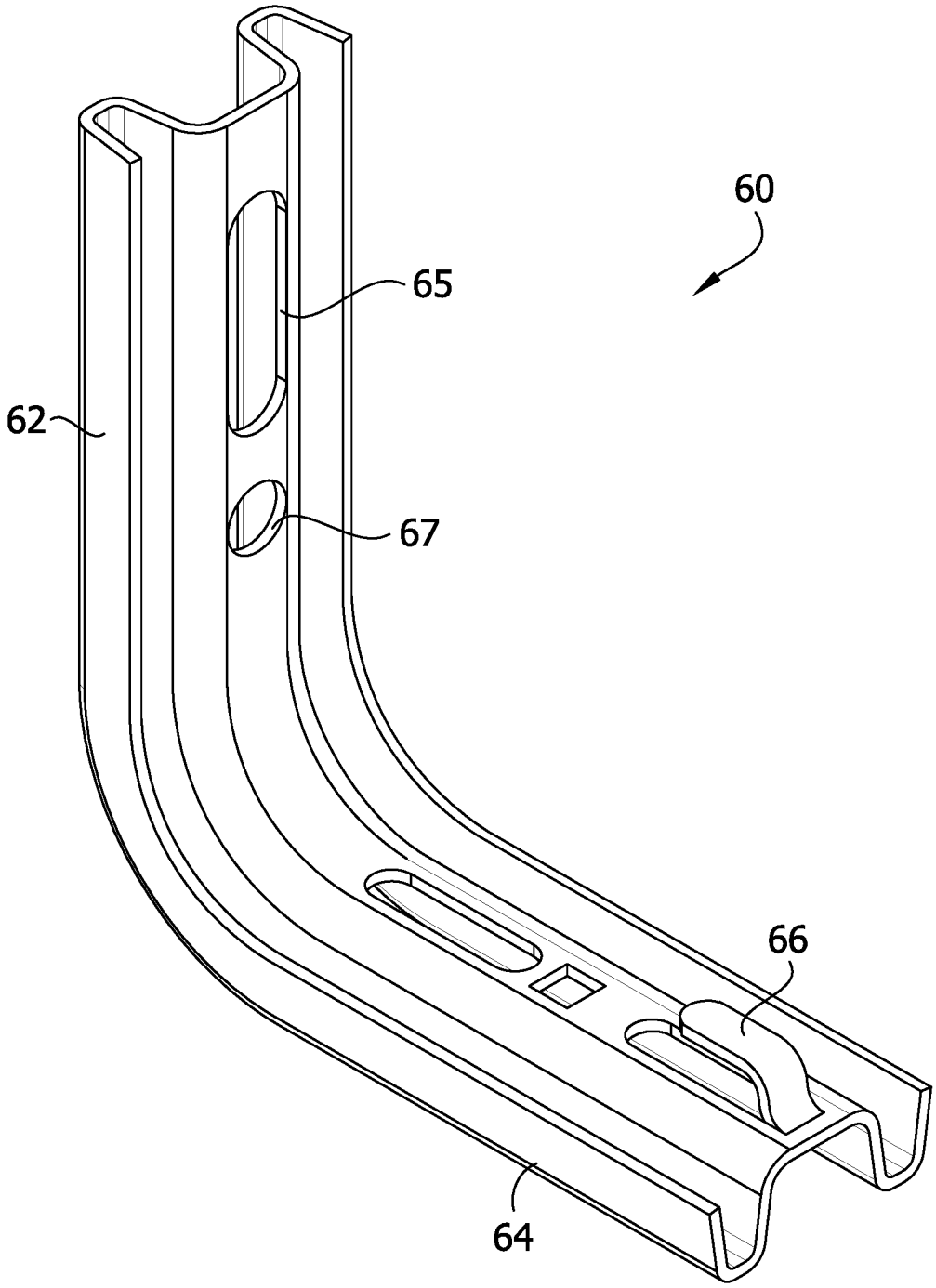
FIG. 8 is a perspective of a bracket of the cable containment system.
Figure 9:
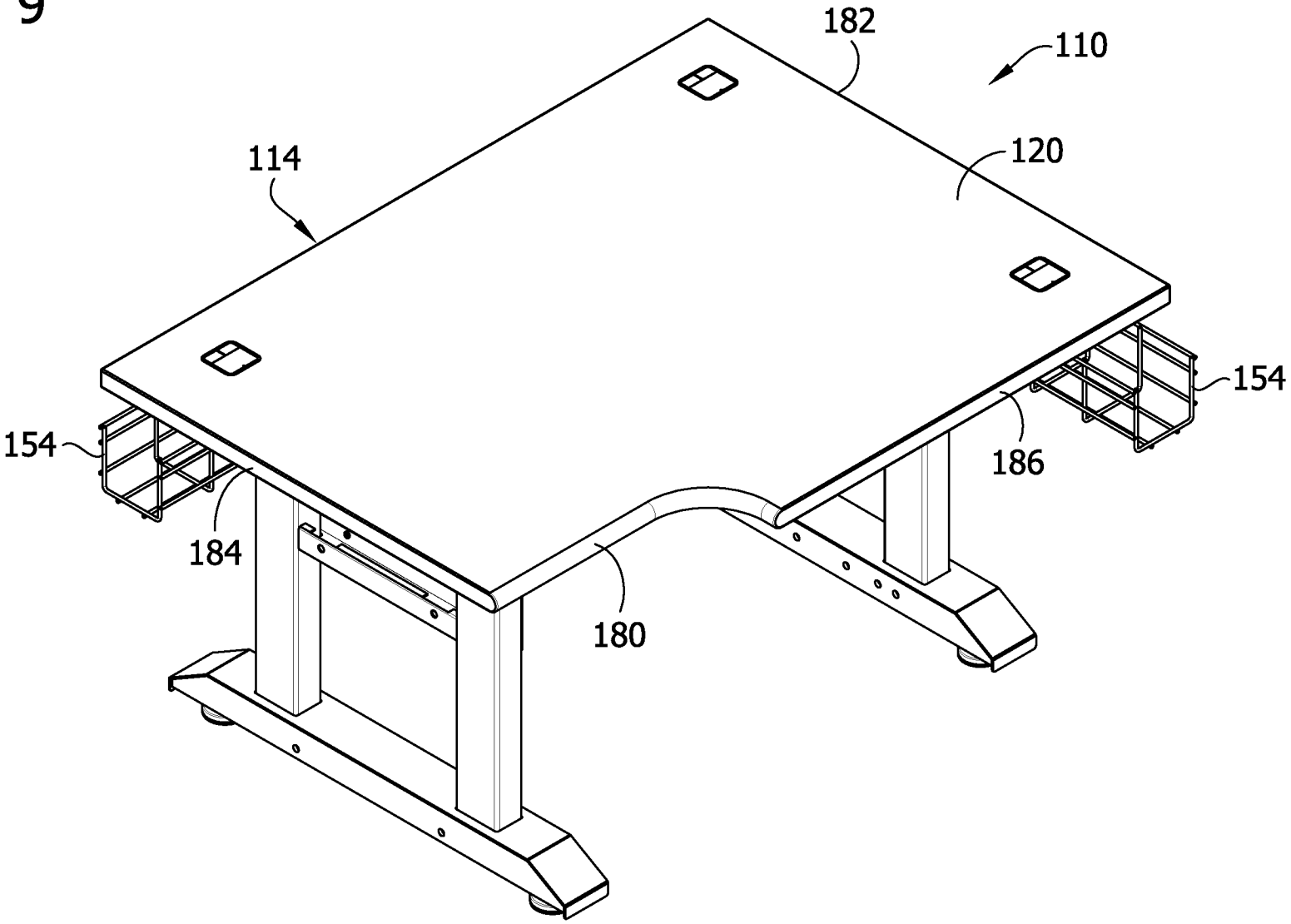
FIG. 9 is a front perspective of a workstation of another embodiment in a sitting configuration.
Figure 10:
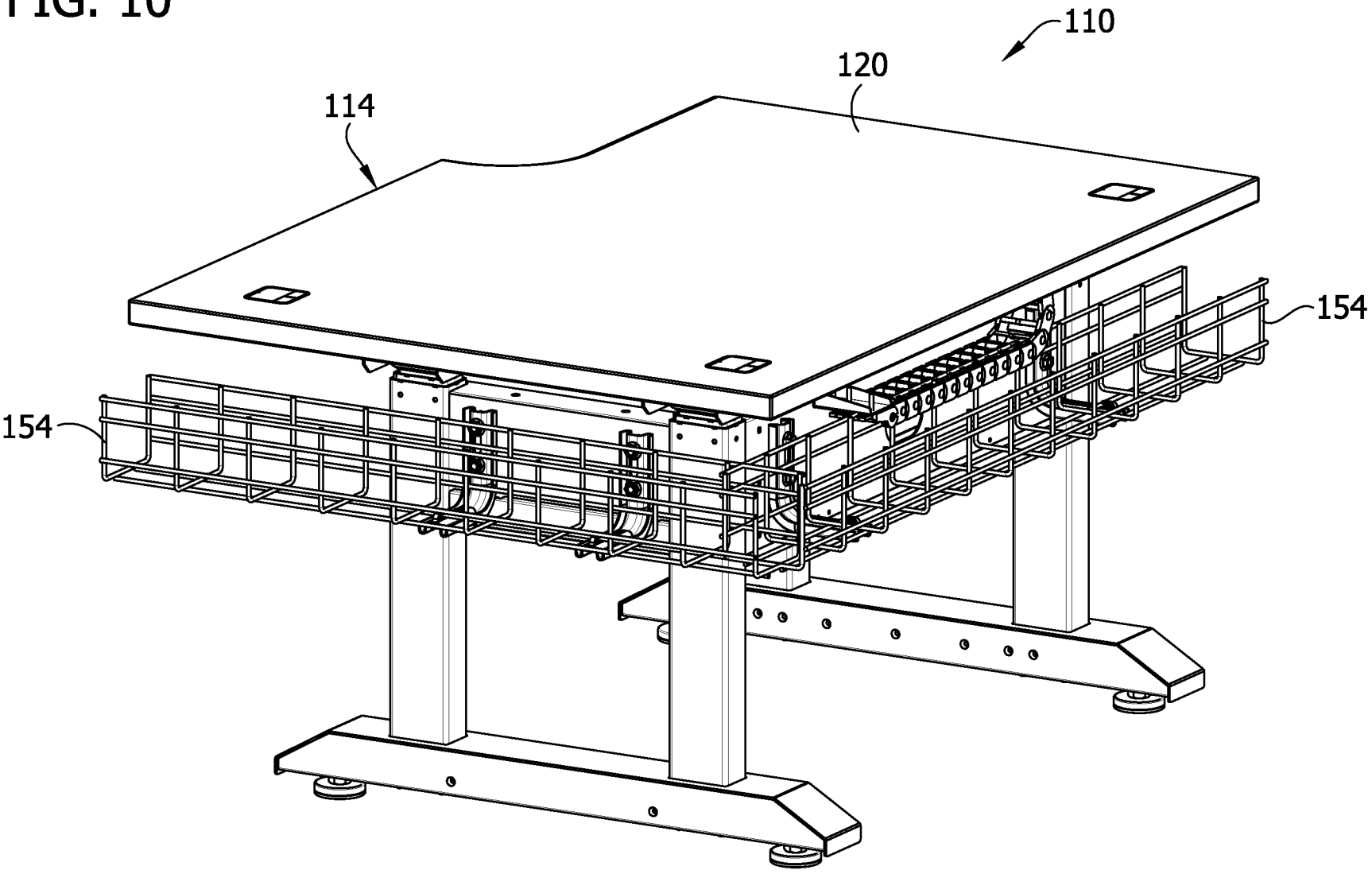
FIG. 10 is a rear perspective of the workstation in FIG. 9.
Figure 11:
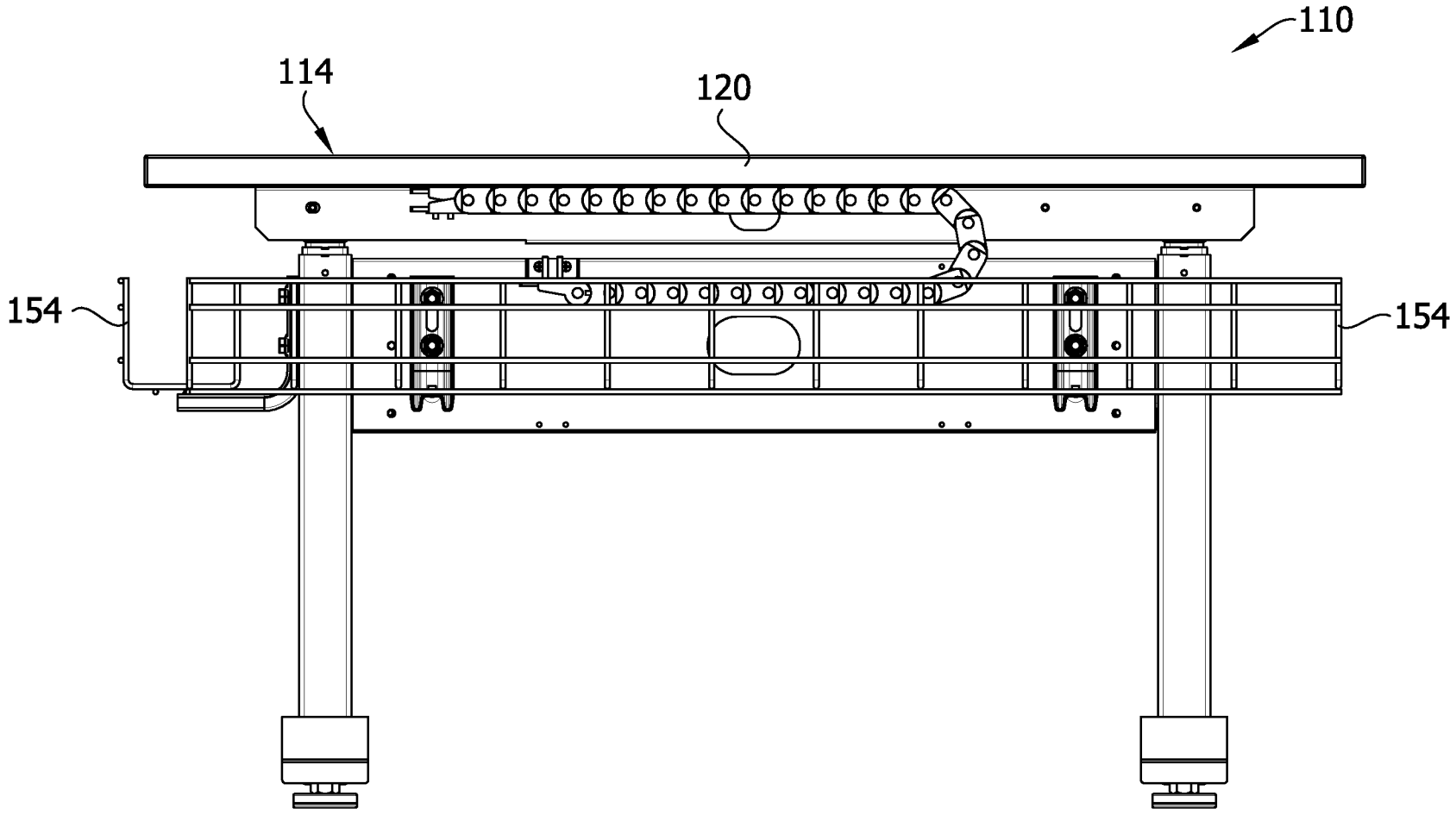
FIG. 11 is a side elevation of the workstation in FIG. 9.
Figure 12:
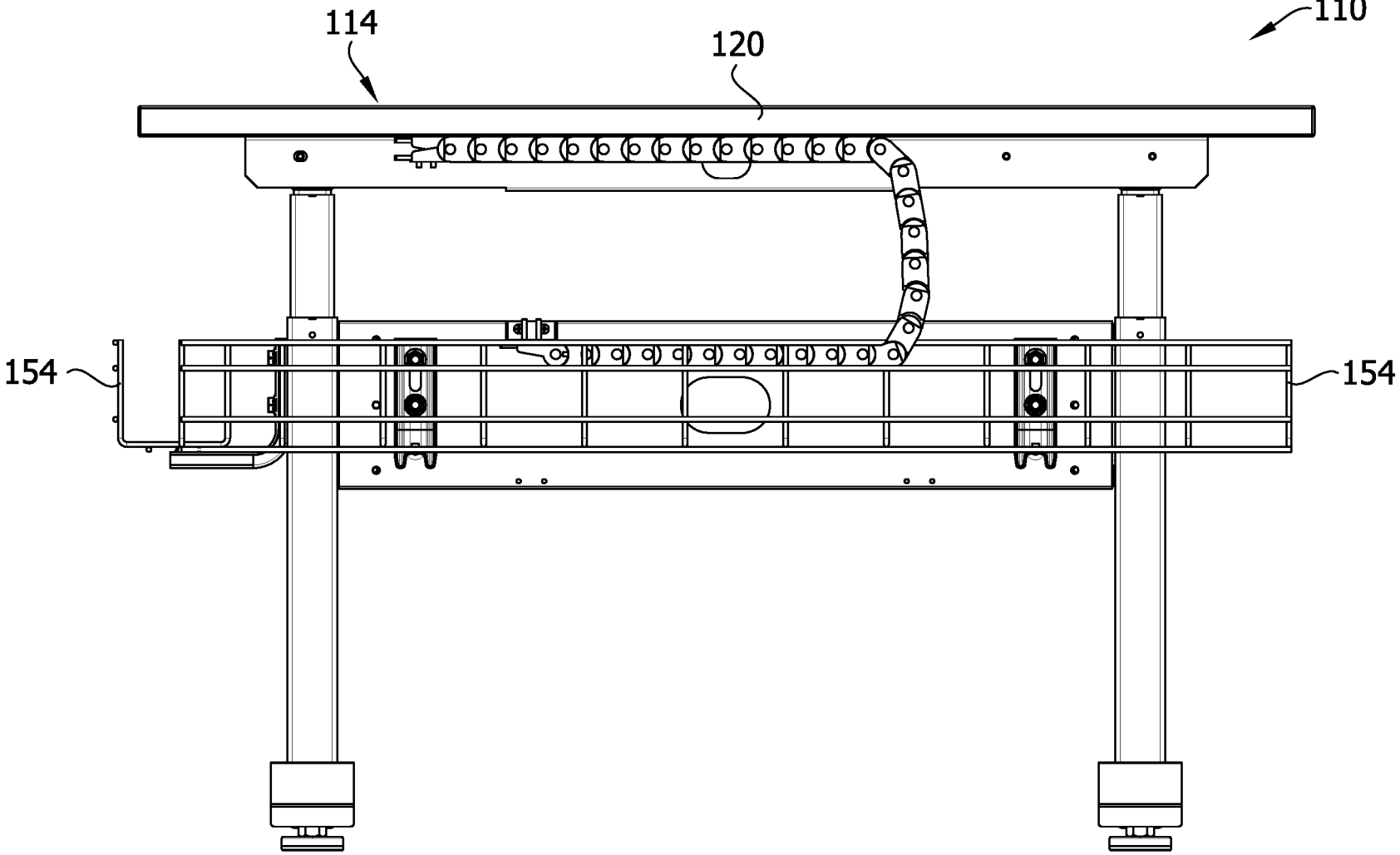
FIG. 12 is a side elevation of the workstation in FIG. 9 in a standing configuration with a tabletop assembly in an elevated position.

Referring to FIG. 7, a perimeter edge of the work platform 20 of the tabletop assembly 14 generally overlies the base assembly 12 such that a footprint of the base assembly generally lies within the perimeter of the table top assembly 14. In the illustrated embodiment, only a small portion of the feet 34 extend outside of the perimeter of the tabletop assembly 14. However, the remainder of the base assembly 12 and lifts 16 are contained within the perimeter of the table top assembly 14. It is envisioned that a greater amount of the feet 34 and/or additional portions of the base assembly 12 could extend outside of the perimeter of the tabletop assembly 14 without departing from the scope of the disclosure.

Referring to FIGS. 2-6, the cable containment system 25 includes cable ports 50 formed in the work platform 20, one or more cable chains 52 mounted, at one end, to a bottom surface of the work platform generally under one of the cable ports and mounted at an opposite end to the base assembly 12, and one or more cable raceways 54 mounted to the base assembly under the one or more cable chains. Cables 56 from devices (not shown) mounted on the work platform 20 may be routed through the cable ports 50 in the work platform 20. Suitably, the ports 50 are generally aligned with the cable chains 52. In the illustrated embodiment, a single cable chain 52 in shown. The single cable chain 52 is positioned to receive cables routed through the cable port 50 located above the single cable chain. However, it is envisioned that a second cable chain (not shown) could be mounted beneath the other cable port 50 in the work platform 20. The cable chain 52 comprises a link of chain members that are movable relative to each other so that the cable chain can move in response to the tabletop assembly 14 being moved relative to the base assembly 12. At one end, the cable chain 52 is attached directly to a lower surface of the work platform 20. At an opposite end, the cable chain 52 is attached to a cable chain bracket 53 which is attached directly to the rear panel 44 of the base assembly 12. In practice, the cables 56 extend through the cable port 50, along the cable chain 52 and are held within the cable raceways 54 as explained below. The cable chain 52 receives segments of the cables 56 that are long enough to accommodate movement of the tabletop assembly 14 between the sitting position and the standing position. As is generally known in the art, the cable chain 52 is configured to fold the received cable segments into compact configurations that fit beneath the tabletop assembly 14 in the sitting position. Additionally, the cable chain 52 is configured to straighten the cable segments when the tabletop assembly 14 is moved to the standing position. The cables 56 may be secured to the cable chain 52 in any suitable fashion.

Referring to FIGS. 2-6 and 8, the cable raceways 54 are mounted to the rear panel 44 of the base assembly 12. In the illustrated embodiment, two cable raceways 54 are shown mounted one on top of the other in a vertically spaced apart fashion. However, a single cable raceway 54 or more than two raceways may be mounted to the base assembly 12 without departing from the scope of the disclosure. Each cable raceway 54 comprises an elongate wire basket mounted to the rear panel 44 by brackets 60. Each bracket includes a vertical extension portion 62 attached to the rear panel 44, and a horizontal extension portion 64 extending from the vertical extension portion to support a cable raceway 54. The vertical extension portion 64 defines a slot 65 and an opening 67 for receiving fasteners (not shown) to attach the bracket 60 to the rear panel 44. A tab 66 (FIG. 8) is formed in each horizontal extension portion 64 and receives a wire of one of the wire baskets 54 to secure the wire basket to the bracket 60. Thus, the wire baskets 54 can be removably mounted on the base assembly 12 by engaging and disengaging wires of the wire baskets with the tabs 66 of the brackets. In the illustrated embodiment, each wire basket 54 extends longitudinally along the base assembly 12 generally between the longitudinal ends of the work platform 20. The wire baskets 54 are centered on the base assembly 12 and they each have a length L (FIG. 4) that is slightly shorter than a length of the work platform 20 so that longitudinal ends of the wire baskets 54 are disposed inward from lateral side edges 68 of the work platform. A depth D (FIG. 6) of the wire baskets 54 is such that when they are mounted on the brackets 60 an outer longitudinal side 70 of each wire basket is disposed inward from a back side edge 72 of the work platform 20. Therefore, the one or more cable raceways 54 and the one or more cable chains 52 are disposed entirely within the perimeter of the work platform 20. This ensures that the cables 56 held by the containment system 25 are also contained within the perimeter of the work platform which provides a compact containment system. The cable raceways 54 may be installed at other locations on the workstation 10 and have other dimensions and orientations in other embodiments. Further, it will be understood that cables 56 may be routed from the wire baskets 54 to locations remote from the workstation 10. In one embodiment, the two cable raceways 54 define a primary and a secondary raceway, respectively, used to separately route different kinds of cables along the base assembly 12 to physically separate the cables and thereby limit electrical interference.

Accordingly, the illustrated workstation 10 provides a vertically adjustable tabletop assembly 14 on a base assembly 12. The tabletop assembly 14 is sized to generally correspond to the footprint of the base assembly 12, which may minimize pinch points of the device when the elevation of the work platform 20 is adjusted. Moreover, the workstation 10 provides an integrated cable management system 25 that organizes cables for worktop mounted electronic equipment, while allowing the electronic equipment to move vertically with the work platform 20 between the standing and sitting positions. The cable management system 25 also has a compact configuration such that it is contained within the perimeter of the table top assembly 14. The cable chain 54 contains the portions of the cables 56 extending between the movable tabletop assembly 14 and the stationary base assembly 12, and the raceways 54 organize the portions of the cables that extend below the cable chain. Each cable 56 may be routed out of the cable raceways 54 at an exit location (i.e., longitudinal ends of the raceway or within gaps between the wires). As illustrated, the workstation 10 includes two cable raceways 54 for maintaining physical separation between sets of cables that could interfere with one another.

Figure 13:
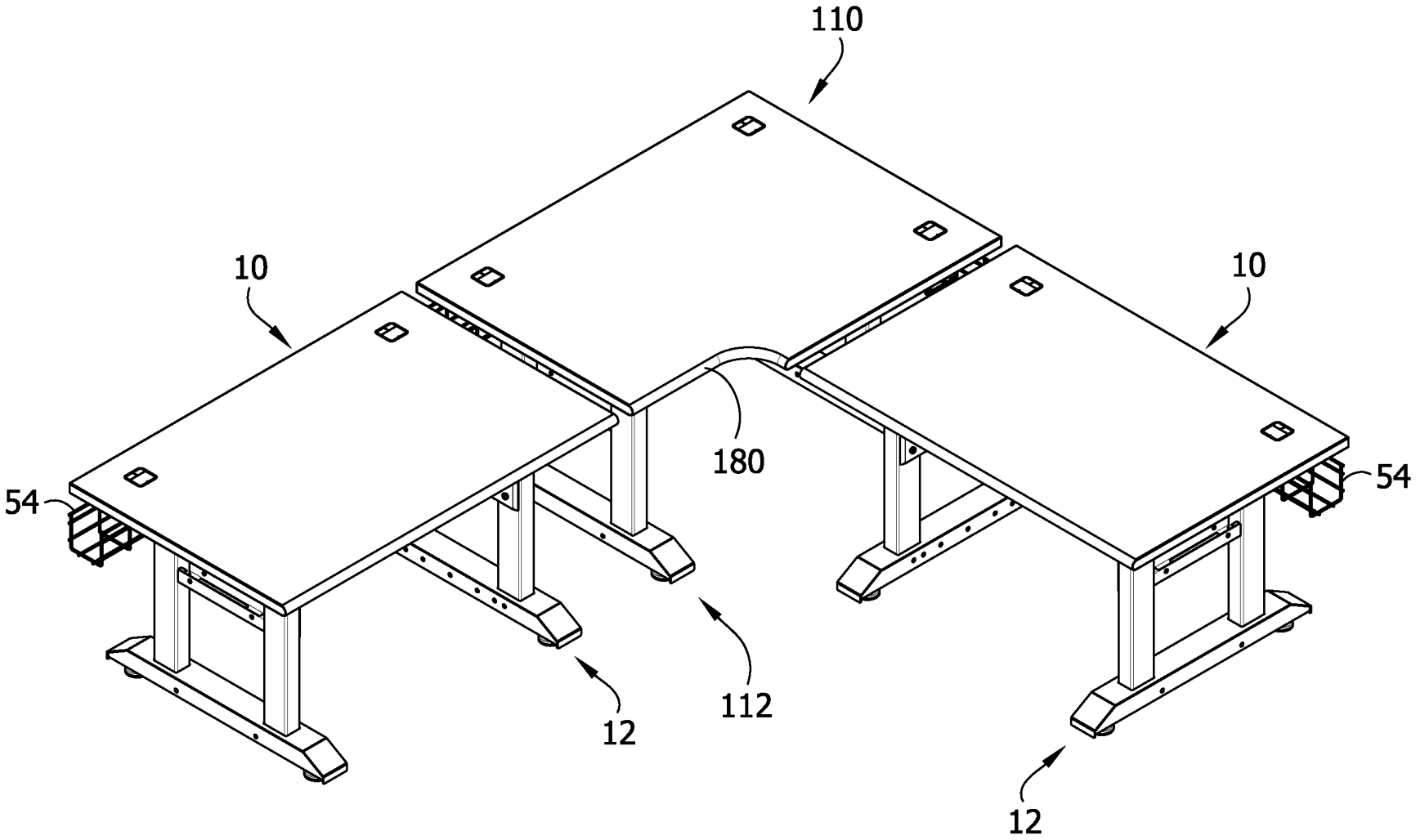
FIG. 13 is a front perspective of a workstation assembly showing the workstations arranged side-by-side.

Referring to FIGS. 9-12, a workstation of another embodiment is generally indicated at 110. Workstation 110 is similar to the workstation 10 of the first embodiment except that workstation 110 comprises a "corner" workstation. Thus, for ease of comprehension, where analogous parts are used, reference numerals "100" units higher are employed (relative to workstation 10). Regarding workstation 110, the corner workstation 110 includes a tabletop assembly 114 including a work platform 120 having a recessed front edge section 180 with a rounded corner to provide a smooth transition when the corner workstation is attached to workstations 10 (FIG. 13). The recessed front edge section 180 forms a wide end 182 and a narrow end 184. The narrow end 184 and a side engagement face 186 are sized to mate with ends of workstations 10. Additionally, raceways 154 are mounted on two rear sides of the workstation 110 for routing cables around the back of the corner workstation 110. The workstation 110 otherwise operates in the same manner as the workstation 10 of the first embodiment.

Figure 14:
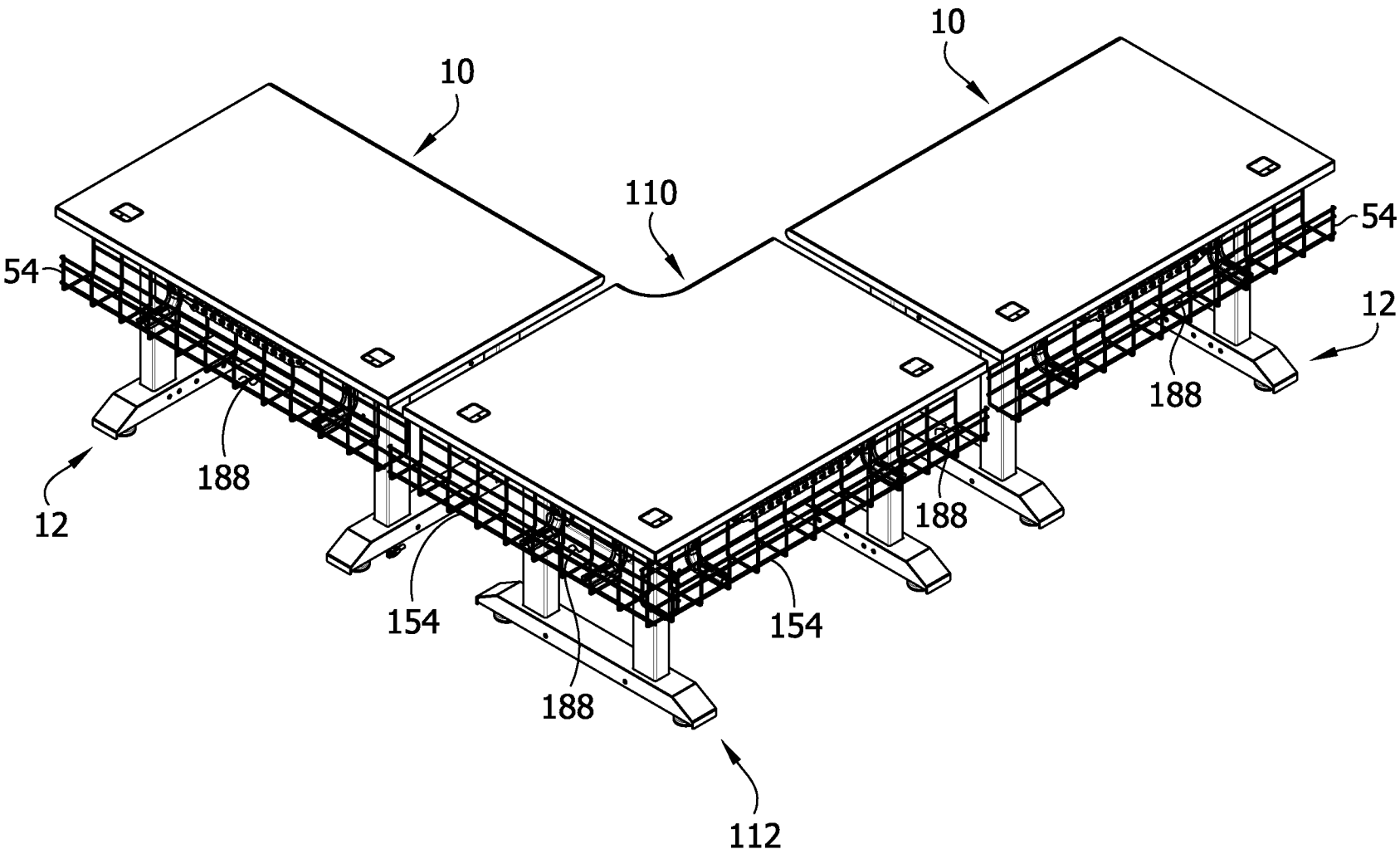
FIG. 14 is a rear perspective of the workstation assembly in FIG. 13.

Referring to FIGS. 13 and 14, when multiple work stations 10, 110 are arranged next to one another, the cable raceways 54, 154 of the work stations are positioned in side-by-side arrangement with one another to form a substantially continuous cable raceway channel 188 extending between the work stations 10, 110. In this manner, cables 56 from one workstation 10, 110 can be routed to and networked with cables of another workstation. This is facilitated by the cable raceways 54, 154 being positioned at about the same height and about the same depth on the base assemblies 12, 112 of the different workstations 10, 110. Therefore, the uniform positioning of the raceways 54, 154 on the base assemblies 12, 112 operatively aligns the raceways of one workstation with the raceways of another workstation. Additionally, the workstations 10 may be provided in a variety of lengths. In one embodiment, the workstations 10 have a length of about 46 inches. In other embodiments, the workstations 10 may have a length of about 48 inches, 60 inches, 72 inches, or 96 inches. Still other lengths are envisioned within the scope of the disclosure.

Figure 15:
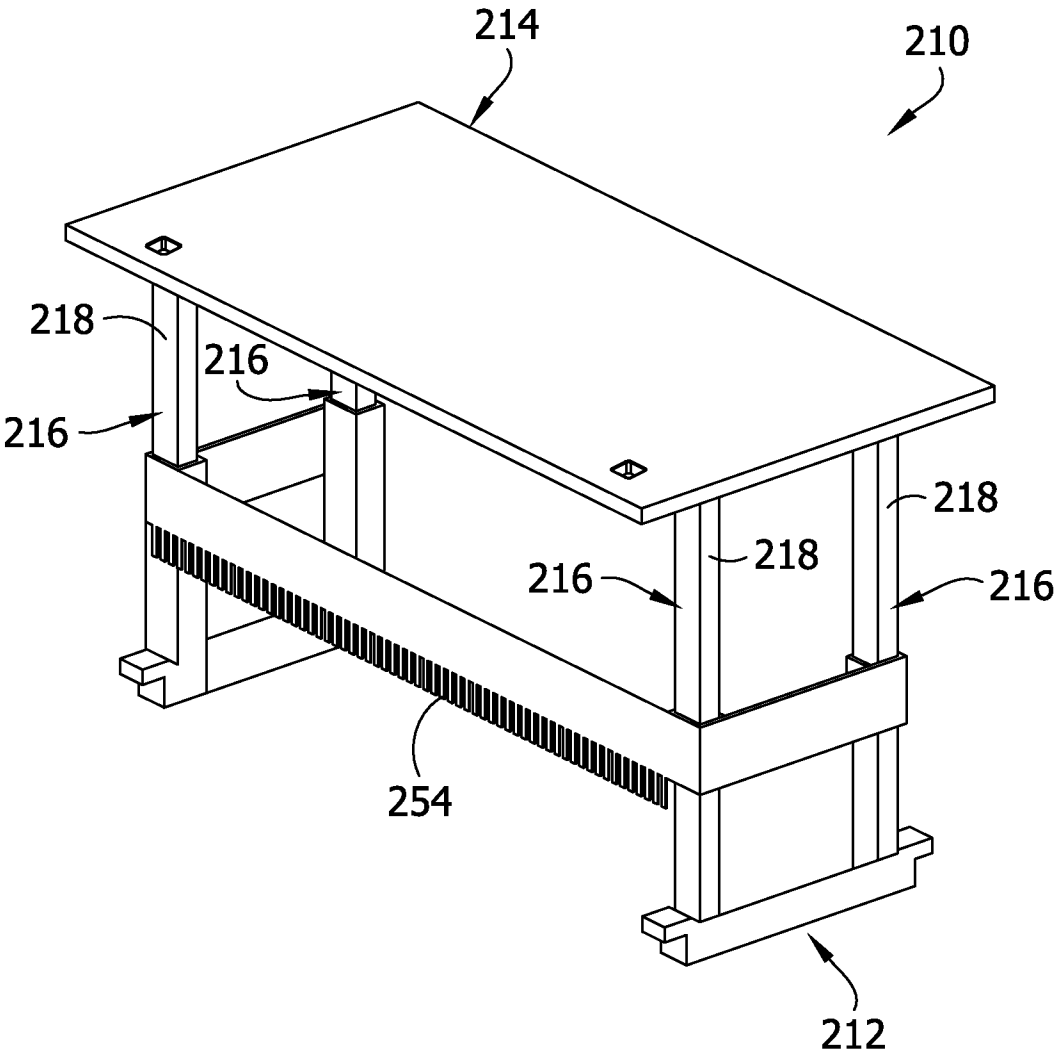
FIG. 15 is a perspective of a workstation of another embodiment.

Referring to FIG. 15, a workstation of another embodiment is generally indicated at 210. Workstation 210 is similar to the workstation 10 of the first embodiment thus, for ease of comprehension, where analogous parts are used, reference numerals "200" units higher are employed (relative to workstation 10). The workstation 210 generally operates in the same manner as the workstation 10 except that workstation 210 does not include any cable chains and the lifts 216 comprise lift motors which move telescoping extension member 218 to move a tabletop assembly 214 relative to base assembly 212. Additionally, the workstation 210 includes only a single raceway 254 mounted to the base assembly 212. However, additional raceways could be added without departing from the scope of the disclosure.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A height-adjustable workstation comprising:

a base assembly for being supported on a floor of a workspace;

a work platform disposed above the base assembly, the work platform having an upper surface, a lower surface, and side edges extending between the upper and lower surfaces and defining a perimeter of the work platform;

a lift operatively connected to the work platform and configured to selectively adjust an elevation of the work platform above the base assembly; and a cable containment system mounted on the base assembly, the cable containment system comprising at least one cable containment component for containing cables associated with a device configured to be supported on the upper surface of the work platform, the at least one cable containment component comprising a raceway mounted to the base assembly for receiving the cables associated with the device configured to be supported on the work platform, and brackets attached to the base assembly, each bracket comprising a vertical extension portion and a horizontal extension portion extending from the vertical extension portion and supporting the raceway, wherein the vertical extension portion of each bracket defines a slot for receiving a fastener to attach the bracket to the base assembly; and wherein the raceway comprises an elongate wire basket, the horizontal extension portion including a tab engaging a wire of the wire basket at a bottom of the wire basket to secure the wire basket to the bracket, the tab including a first section extending upward from the horizontal extension portion of the bracket, and a second section extending from the first section toward the vertical extension portion of the bracket.

2. The height-adjustable workstation set forth in claim 1, wherein the cable containment system comprises a cable chain mounted to the lower surface of the work platform at one end of the cable chain and mounted to the base assembly at an opposite end of the cable chain.

3. The height-adjustable workstation set forth in claim 2, wherein the raceway is mounted directly below the cable chain.

4. The height-adjustable workstation set forth in claim 3, wherein the base assembly comprises support legs and a panel attached to the support legs, the raceway being mounted to the panel.

5. The height-adjustable workstation set forth in claim 4, wherein the brackets are attached to the panel for mounting the raceway to the panel.

6. The height-adjustable workstation set forth in claim 4, wherein the vertical extension portion is attached directly to the panel.

7. The height-adjustable workstation set forth in claim 1, wherein the cable containment system comprises a plurality of raceways mounted to the base for receiving the cables associated with the device configured to be supported on the work platform.

8. The height-adjustable workstation set forth in claim 1, wherein the work platform has a rectangular shape.

9. The height-adjustable workstation set forth in claim 1, wherein the work platform has a generally square shape.

10. The height-adjustable workstation set forth in claim 1, wherein an entirety of the cable containment system is disposed within the perimeter of the work platform.

11. The height-adjustable workstation set forth in claim 1, wherein the tab has a base attached to the horizontal extension portion, the tab extending rearwardly toward the vertical extension portion.

12. The height-adjustable workstation set forth in claim 1, wherein the bracket comprises an L-shaped structure having a pair of longitudinally extending concave side sections and a longitudinally extending convex center section.

13. A workstation assembly comprising:

a first height-adjustable workstation comprising a base assembly, a work platform disposed above the base assembly, a lift operatively connected to the work platform and configured to selectively adjust an elevation of the work platform above the base assembly, and a cable containment system mounted on the base assembly, the cable containment system comprising at least one cable containment component for containing cables associated with a device configured to be supported on the work platform, the at least one cable containment component including a raceway mounted to the base assembly for receiving the cables associated with the device configured to be supported on the work platform, and brackets attached to the base assembly, each bracket comprising a vertical extension portion and a horizontal extension portion extending from the vertical extension portion and supporting the raceway, wherein the vertical extension portion of each bracket defines a slot for receiving a fastener to attach the bracket to the base assembly, wherein the raceway comprises an elongate wire basket, the horizontal extension portion including a tab engaging a wire of the wire basket at a bottom of the wire basket to secure the wire basket to the bracket, the tab including a first section extending upward from the horizontal extension portion of the bracket, and a second section extending from the first section toward the vertical extension portion of the bracket; and a second height-adjustable workstation comprising a base assembly, a work platform disposed above the base assembly of the second height-adjustable workstation, a lift operatively connected to the work platform of the second height-adjustable workstation and configured to selectively adjust an elevation of the work platform of the second height-adjustable workstation above the base assembly of the second height-adjustable workstation, and a cable containment system mounted on the base assembly of the second height-adjustable workstation, the cable containment system of the second height-adjustable workstation comprising at least one cable containment component for containing cables associated with a device configured to be supported on the work platform of the second height-adjustable workstation, the at least one cable containment component of the cable containment system of the second height-adjustable workstation including a raceway mounted to the base assembly of the second height-adjustable workstation for receiving the cables associated with the device configured to be supported on the work platform of the second height-adjustable workstation, and brackets attached to the base assembly of the second height-adjustable workstation, each bracket of the second height-adjustable workstation comprising a vertical extension portion and a horizontal extension portion extending from the vertical extension portion and supporting the raceway of the second height-adjustable workstation, wherein the vertical extension portion of each bracket of the second height-adjustable workstation defines a slot for receiving a fastener to attach the bracket to the base assembly of the second height-adjustable workstation, wherein the raceway of the second height-adjustable workstation comprises an elongate wire basket, the horizontal extension portion of the brackets of the second height-adjustable workstation including a tab engaging a wire of the wire basket of the second height-adjustable workstation at a bottom of the wire basket of the second height-adjustable workstation to secure the wire basket of the second height-adjustable workstation to the bracket of the second height-adjustable workstation, the tab on the horizontal extension portion of the bracket of the second height-adjustable workstation including a first section extending upward from the horizontal extension portion of the bracket of the second height-adjustable workstation, and a second section extending from the first section of the tab on the horizontal extension portion of the bracket of the second height-adjustable workstation toward the vertical extension portion of the bracket of the second height-adjustable workstation.

14. The workstation assembly set forth in claim 13, wherein the cable containment system of each of the first and second height-adjustable workstations comprises a cable chain mounted to the respective work platform at one end of the cable chain and mounted to the respective base assembly at an opposite end of the cable chain.

15. The workstation assembly set forth in claim 14, wherein each raceway is mounted directly below a respective cable chain.

16. The workstation assembly set forth in claim 13, wherein the work platform of the first height-adjustable workstation has a rectangular shape, and the work platform of the second height-adjustable workstation has a generally square shape.

17. The workstation assembly set forth in claim 13, wherein the work platforms of the first and second height-adjustable workstations each have a rectangular shape.

18. The workstation assembly set forth in claim 13, wherein the cable containment component of the first height-adjustable workstation is disposed at a same height as the cable containment component of the second height-adjustable workstation so that cables can be routed between the first height-adjustable workstation and the second height-adjustable workstation.

19. A height-adjustable workstation comprising:

a base assembly for being supported on a floor of a workspace;

a work platform disposed above the base assembly, the work platform having an upper surface, a lower surface, and side edges extending between the upper and lower surfaces and defining a perimeter of the work platform;

a lift operatively connected to the work platform and configured to selectively adjust an elevation of the work platform above the base assembly; and a cable containment system mounted on the base assembly, the cable containment system comprising at least one cable containment component for containing cables associated with a device configured to be supported on the upper surface of the work platform, the at least one cable containment component comprising a raceway mounted to the base assembly for receiving the cables associated with the device configured to be supported on the work platform, and brackets attached to the base assembly, each bracket comprising a vertical extension portion and a horizontal extension portion extending from the vertical extension portion and supporting the raceway, wherein the vertical extension portion of each bracket defines a slot for receiving a fastener to attach the bracket to the base assembly, and wherein the bracket comprises an L-shaped structure having a pair of longitudinally extending concave side sections and a longitudinally extending convex center section.

* * * * *